United States Patent [19]

Watanabe et al.

[11] Patent Number: 4,458,589

[45] Date of Patent: Jul. 10, 1984

[54] COMPACT PRINTER HAVING A TYPEFONT BELT WITH A TYPE-FREE PORTION

[75] Inventors: Satoshi Watanabe, Chichibu; Toru Wakazawa, Yokoze; Hirofumi Hirano, Arakawa; Hiroshi Nishizawa; Setsuo Sasaki, both of Chichibu, all of Japan

[73] Assignees: Canon Kabushiki Kaisha, Tokyo; Canon Denshi Kabushiki Kaisha, Saitama, both of Japan

[21] Appl. No.: 457,519

[22] Filed: Jan. 13, 1983

Related U.S. Application Data

[63] Continuation of Ser. No. 195,349, Oct. 9, 1980, abandoned.

[30] Foreign Application Priority Data

| | | | |
|---|---|---|---|
| Oct. 31, 1979 | [JP] | Japan | 54-139953 |
| Oct. 31, 1979 | [JP] | Japan | 54-139954 |
| Oct. 31, 1979 | [JP] | Japan | 54-139955 |
| Oct. 31, 1979 | [JP] | Japan | 54-139956 |

[51] Int. Cl.[3] ..... B41J 1/22

[52] U.S. Cl. ..... 101/110; 101/93.23; 101/111

[58] Field of Search ..... 101/93.13, 93.14, 93.21, 101/93.26, 415.1, 378, 111, 99, 110, 148, 93.23

[56] References Cited

U.S. PATENT DOCUMENTS

| | | | |
|---|---|---|---|
| 2,919,641 | 1/1960 | Pfleger | 101/110 X |
| 3,213,790 | 10/1965 | McKay | 101/415.1 |
| 3,326,346 | 6/1967 | Sasaki | 101/110 X |
| 3,509,819 | 5/1970 | Conole | 101/378 |
| 3,717,234 | 2/1973 | Koller | 400/146 X |
| 3,848,527 | 11/1974 | Nihira | 101/93.23 |
| 4,013,005 | 3/1977 | Keefe | 101/110 |
| 4,075,945 | 2/1978 | Bienholz | 400/146 X |
| 4,095,686 | 6/1978 | Okabe | 101/110 X |

FOREIGN PATENT DOCUMENTS

| | | | |
|---|---|---|---|
| 1931570 | 11/1970 | Fed. Rep. of Germany | 101/110 |

*Primary Examiner*—Edward M. Coven

*Attorney, Agent, or Firm*—Fitzpatrick, Cella, Harper & Scinto

[57] ABSTRACT

This invention provides, in a printing wheel having an internal hammer, a new structure of the typefont belt and a mounting method therefor on the support member. Also a structure of the printing drum and a driving method therefor suitable for intermittent rotation and stop by a stepping motor are disclosed.

5 Claims, 23 Drawing Figures

COMPACT PRINTER HAVING A TYPEFONT BELT WITH A TYPE-FREE PORTION

This is a continuation of application Ser. No. 195,349, filed Oct. 9, 1980, now abandoned.

BACKGROUND OF THE INVENTION

1. Field of the Invention

The present invention relates to a compact printer, and more particularly to a compact printer having a printing drum in which a hammer mechanism is accommodated.

2. Description of the Prior Art

Various types of known printers utilizing a printing drum are classified into those having the hammer mechanism outside the printing drum and those having the hammer mechanism inside the printing.

In the printers utilizing external hammer mechanism, there is already known a so-called flying hammer printer in which a plurality of hammers, positioned to face the printing drum across a recording sheet, are selectively driven by corresponding electromagnets thereby hitting the types in the printing position on the printing wheel through the recording sheet to obtain a print thereon. Also, there is a printer of so-called printing drum selection method in which a platen positioned to face the printing drum across a recording sheet presses the sheet against the printing drum after desired types are aligned by the selective function of a printing drum selecting mechanism which is positioned behind the printing drum, to obtain the desired print.

These known printers are not compact printers because a relatively large space is occupied by the hammer driving mechanism or printing drum selecting mechanism.

Also, the aforementioned flying hammer type printer is associated with a high level noise because the hammers hit the printing drum through the recording sheet. Further, it requires a complicated mechanism for synchronizing the typefont with the hammers as printing occurs by instantaneous impact while the printing drum is rotated, eventually and nonsynchronization occurs leading to errors in printing.

On the other hand the printer of the printing drum selecting system requires a selecting mechanism for each digit of a character to be printed, thus leading to an increased number of component parts which associated with a complicated mechanism, renders it quite difficult to reduce cost.

SUMMARY OF THE INVENTION

An object of the present invention is to provide a compact printer not associated with aforementioned drawbacks and capable of providing a satisfactory print quality.

According to the present invention, the typefont belt is fixed at a type-lacking portion thereof utilized for paper feeding and is provided in said type-lacking portion with a dummy type of a smaller height than other printing types to reduce the amount of displacement of the ink roller, thereby preventing unnecessary ink exudation and avoiding the formation of ink stains. Also such structure improves the molding yield of the typefont belts since the molding burrs eventually present in said dummy type portion do not affect the printing.

Also according to the present invention the typefont belt is shaped as an open sheet of which both extremities are superposed on each other when fixed on the printing drum. Such structure improves the strength of a thus superposed connecting portion, and permits an extremely easy mounting without adhesive if said connection is achieved by an appropriate snap-in structure.

Also according to the present invention, the pulse duration to the stepping motor or the torque thereof is changed at a determined step or point of the printing cycle. For example in the paper feeding step the pulse duration is made larger than in the type selecting step to effect the paper feeding with an increased torque. Stated differenty, the type select-print step requiring a lower load is conducted at a higher frequency while the paper feeding step required a higher load is conducted at a lower frequency. This fact allows the use of a smaller less expensive motor. Also the smaller area required on the printing drum for paper feeding allows the diameter thereof to be reduced, and in this manner it is made possible to obtain a compact printer of a reduced cost.

BRIEF DESCRIPTION OF THE DRAWINGS

The attached drawings illustrate an embodiment of the present invention, wherein FIGS. 1A, 1B and 1C, when combined as shown in FIG. 1, are an exploded perspective view of the drive mechanism.

DESCRIPTION OF THE PREFERRED EMBODIMENTS

The present invention will be clarified by the following description of an embodiment thereof with reference to the attached drawings.

Figure 1:
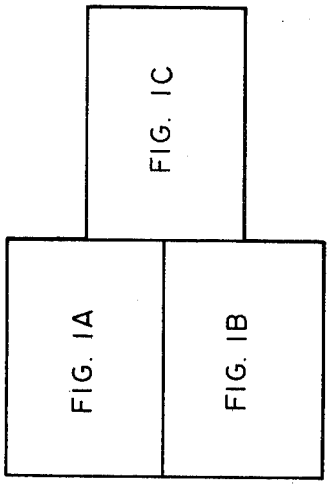
Figure 1A:
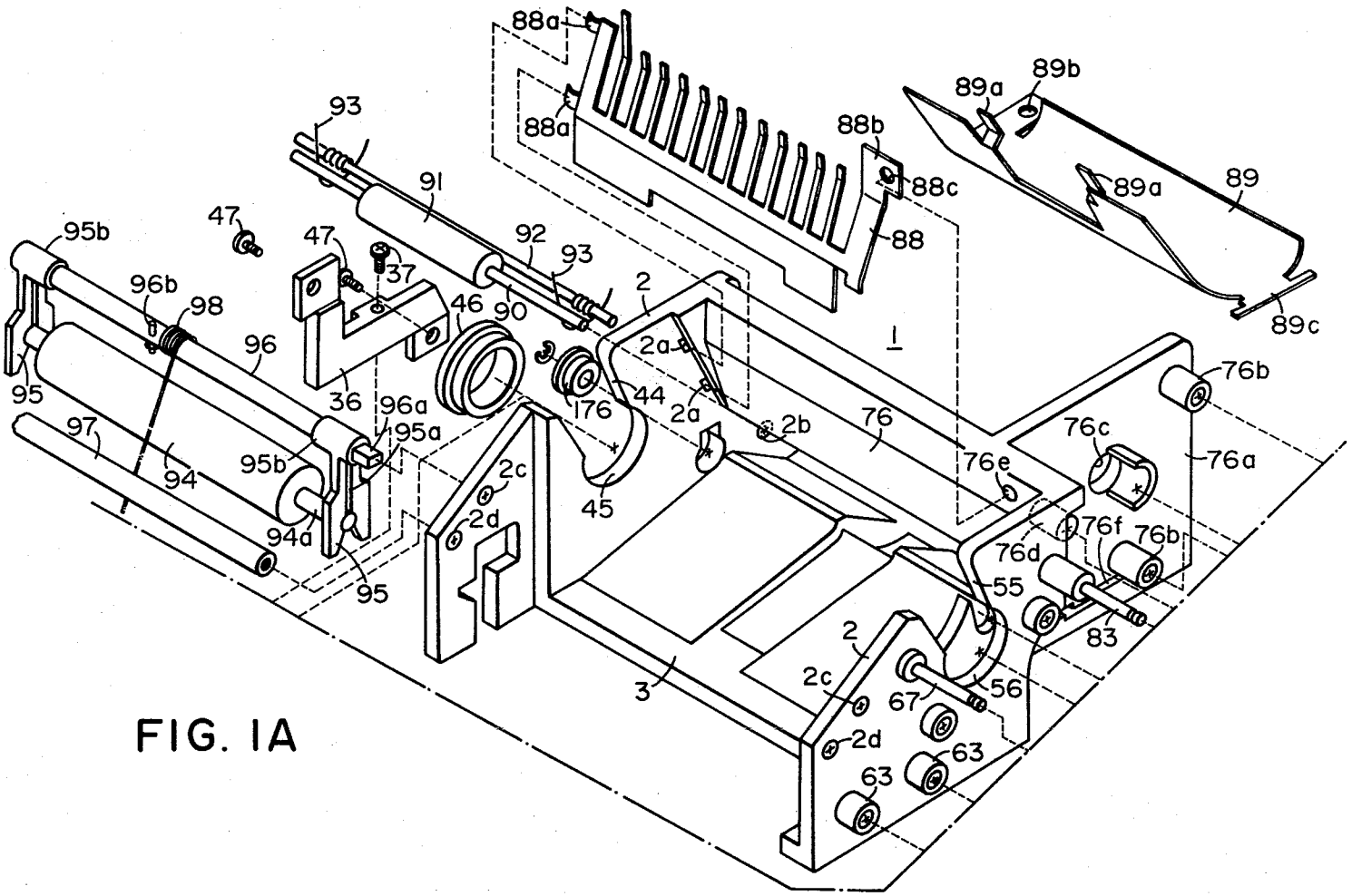
Figure 1B:
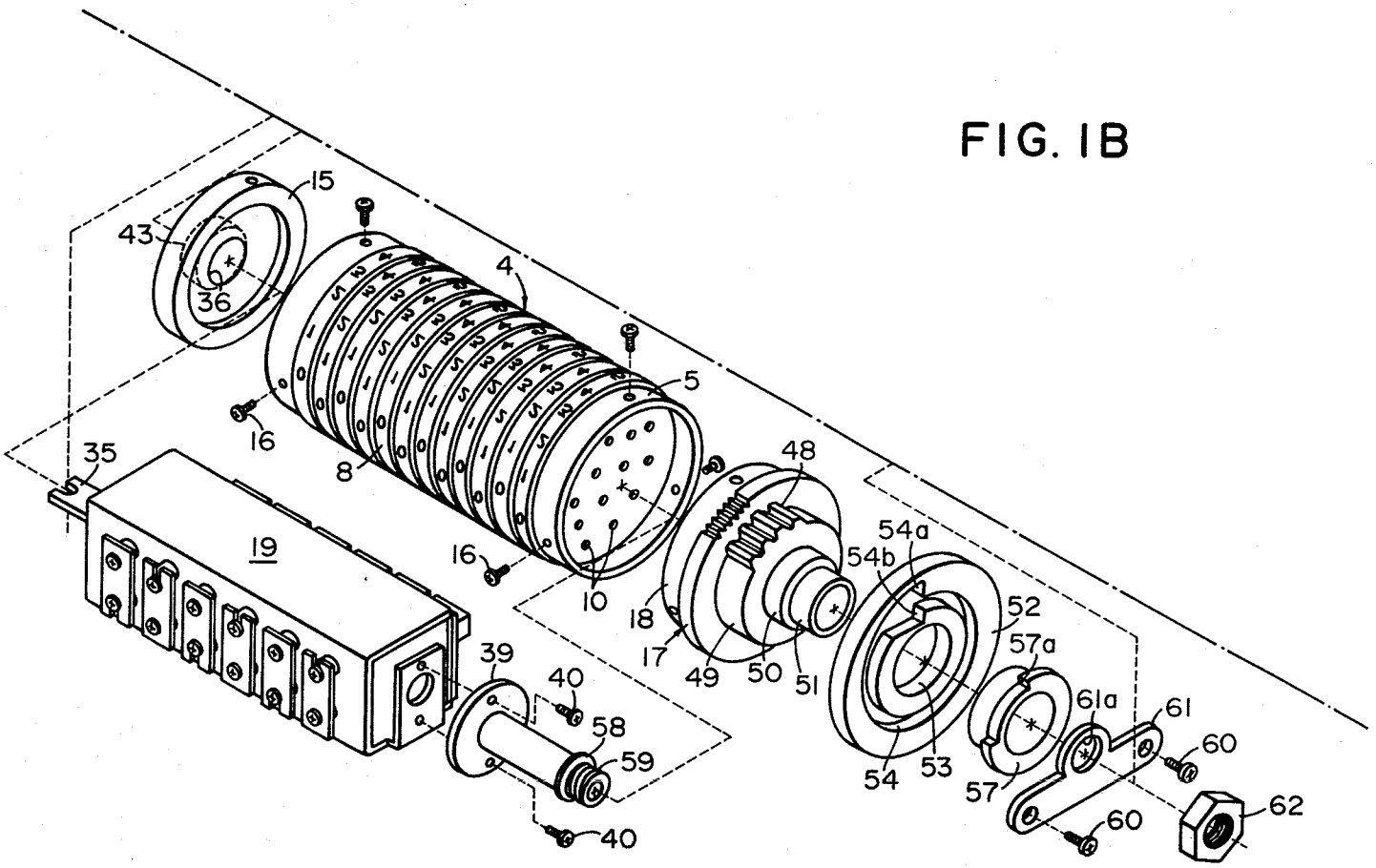
Figure 1C:
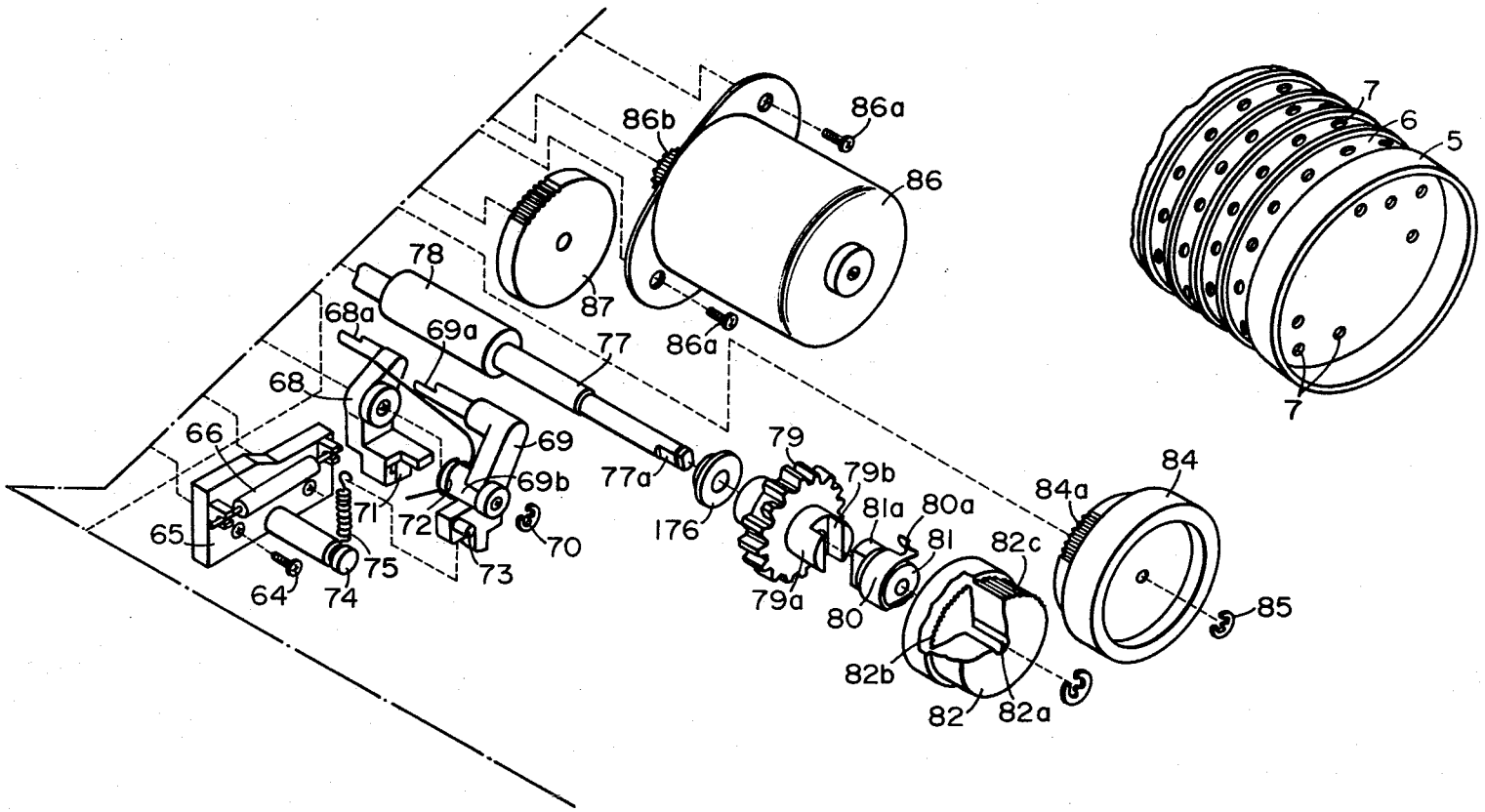

FIGS. 1A, 1B and 1C show, in an exploded perspective view, the principal part of a compact printer embodying the present invention, wherein a frame 1 made for example of a plastic material is provided integrally with side boards 2—2 which are mutually connected by a bottom board 3. A printing drum 4 rotatably housed in frame 1 is essentially composed of a cylindrical support member having, as shown in an attached sketch in FIG. 1, grooves 6 at regular intervals in which holes 7 are formed at regular intervals and with so-called staggered arrangement and in which typefont belts 8 are to be fitted. Typefont belts 8 are made for example of a macromolecular rubber material, such as ethylene-propylene rubber, fluorinated rubber, neoprene rubber, acrylic rubber, chlorprene rubber, chlorosulfonated polyethylene rubber, styrene-butadiene rubber, urethane rubber, NBR or silicone rubber, or a synthetic macromolecular resin such as polyurethane and are formed in rings for fitting in grooves 6 of the support member 5 or in flat strips which are wound around support member 5 to form rings in grooves 6.

The typefont belts 8 are provided on the top face thereof with protruding printing types 9 and, also on the bottom face thereof with protruding portions 10 respectively corresponding to printing types 9, protruding portions 10 being slidably fitted into the holes 7 of the support member 5. Consequently the printing types 9 on the typefont belts 8 likewise have a staggered arrangement between the adjacent typefont belts. The interval of protruding portions 10 of the typefont belts 8 is selected slightly smaller than the interval of holes 7 so that the typefont belts 8 are maintained in a slightly extended and tensioned state on the support member 5, thus achieving a stable mounting thereon and ensuring a high-speed smooth returning movement of the printing types after they are radially driven for printing operation.

Figure 2:
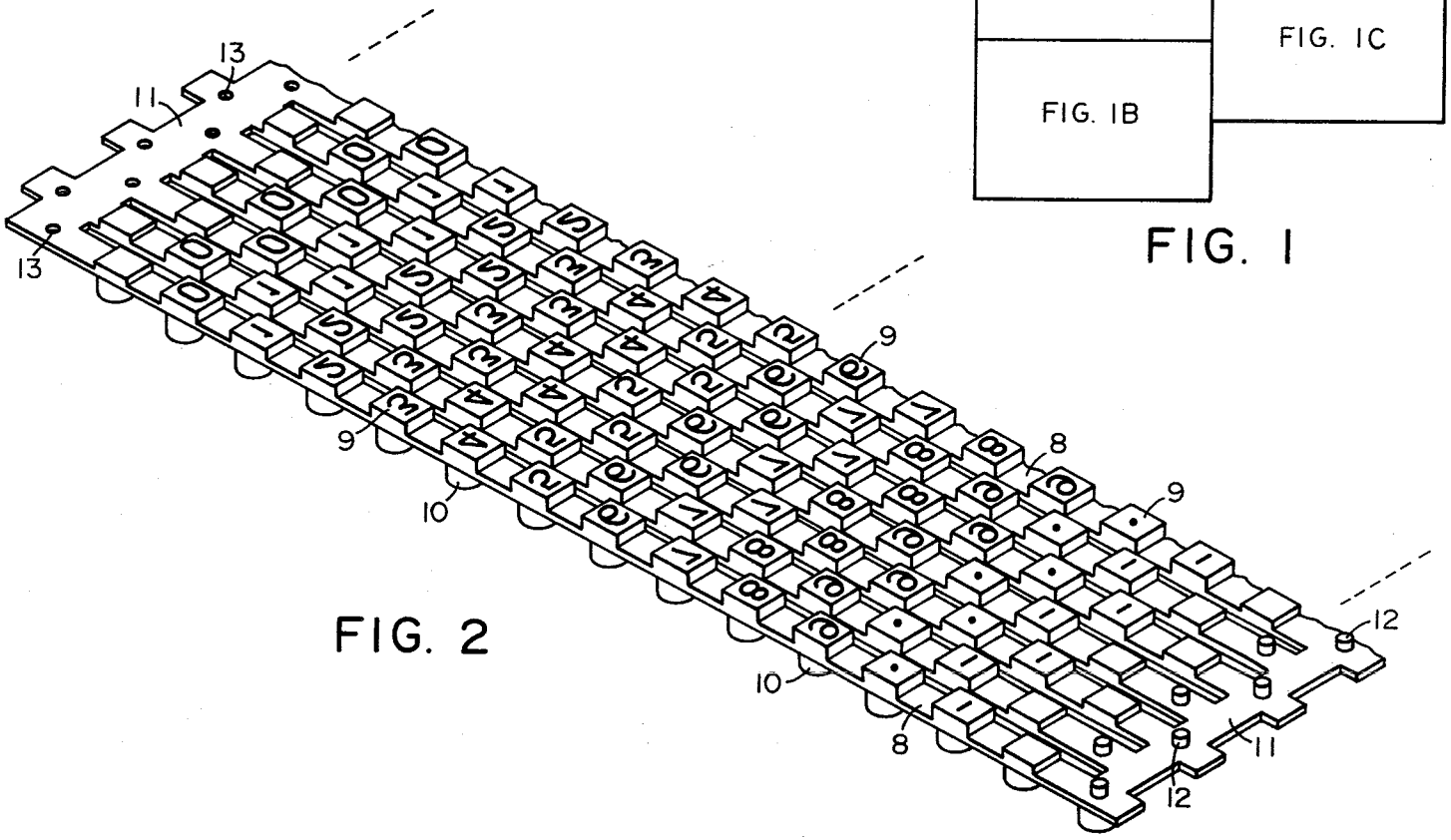
FIG. 2 is a perspective view of a typefont belt.
Figure 3:
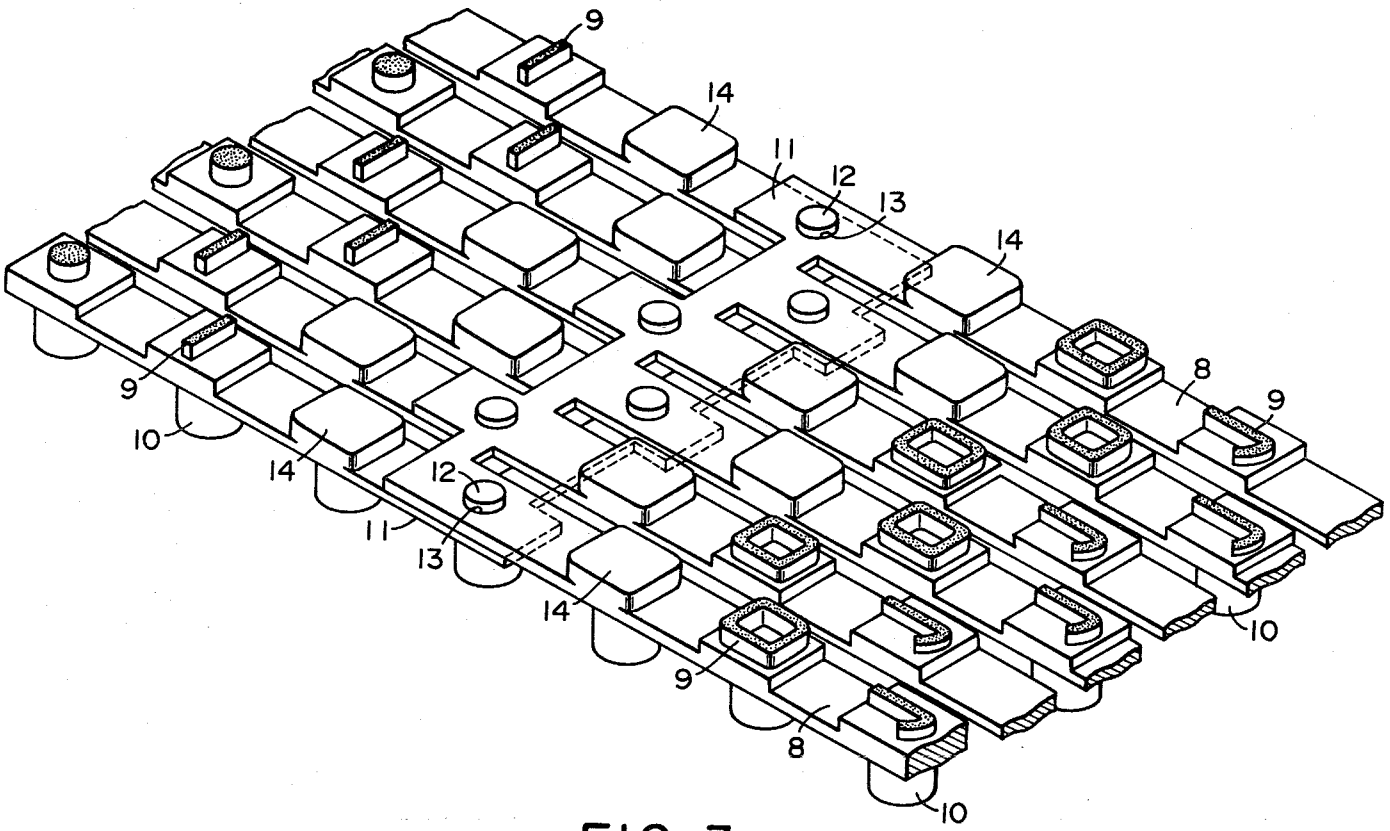
FIG. 3 is a magnified perspective view of the connecting portion of the typefont belt.

The typefont belts 8 of the above-mentioned structure may be composed independently or may be mutually united at the ends thereof by flat portions 11 as shown in FIGS. 2 and 3. One of flat portions 11 is provided on the top face thereof with short cylindrical pins 12 arranged for example in a staggered pattern while the other flat portion 11 is provided with holes 13 into which said pins 12 are to be fitted. Consequently the typefont belts can be connected into an annular shape by fitting the belts in the grooves 6 of the support member 5, superposing flat portions 11—11 and engaging pins 12 with holes 13.

Flat portions 11—11 are positioned in a so-called type-lacking portion of the belts which has no printing type but is utilized for feeding the recording sheet by mechanical sequence in a manner as will be explained later. In the present embodiment, however, the type-lacking portion which conventionally has no printing type is provided with dummy types 14 of a height substantially same as or slightly smaller than that of other printing types, and pins 12 are made with a height substantially same as or slightly smaller than that of other printing types.

The presence of such dummy type reduces the vibratory motion of the ink roller and prevents unnecessarily excessive ink deposition by roller squeezing when the ink roller moves from said type-lacking portion onto the adjacent printing type. Also the above-explained structure is capable of preventing the stain formation eventually caused by the adhesive, which, if used for mounting the typefont belts, may become higher than the printing types. Also a certain amount of burrs is unavoidable in injection molding of typefont belts. However, a somewhat smaller height of the dummy type permits the presence of certain burrs in this portion without practical trouble in the printing operation, thus improving the molding yield of the typefont belts.

Figure 6A:
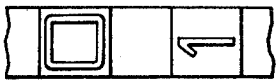
FIGS. 6A and 6B are a plan view and a longitudinal cross-sectional view, respectively, of the typefont belt.
Figure 6B:
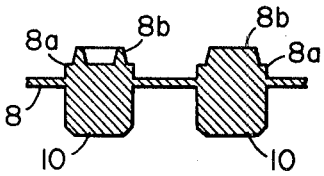
Figure 7A:
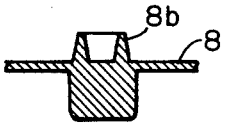
FIG. 7A PRIOR ART
FIGS. 7A and 7B are magnified cross-sectional views showing a conventional typefont belt.
Figure 7B:
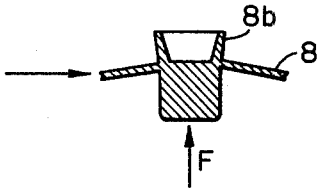
FIG. 7B PRIOR ART
Figure 8:
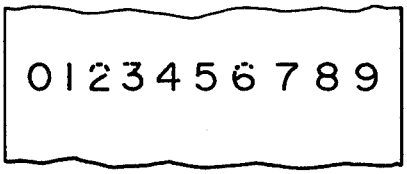
FIG. 8 PRIOR ART
FIG. 8 is an explanatory view showing a print obtained with a conventional typefont belt.
Figure 9:
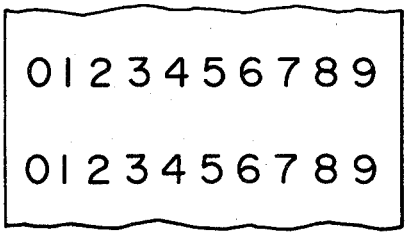
FIG. 9 is an explanatory view showing a print obtained with the typefont belt of the present invention.

The typefont belt 8 of the present embodiment has a structure as shown in FIG. 6, in which a base block 8*a* protrudes from the upper face of the belt 8 and supports a character type 8*b* thereon. Such structure reduces the deformation of the character in comparison with the conventional structure in which, as shown in FIG. 7B, the character type 8*b* is formed directly on the belt 8 and is subjected to deformation when the belt 8 is elongated by the external force F of the hammer, thus resulting in a deformed or partially deficient print and a deterioration in the print quality. On the other hand, the character type 8*b* formed on the base block 8*a* is free from such deformation, thus ensuring a clear print as shown in FIG. 9.

A disc-shaped bracket 15 is fitted in an end of the support member 5 and fixed with screws 16, while a boss portion 18 integral with a gear 17 is fitted into another end of said support member 5 and fixed with screws 16.

Figure 4:
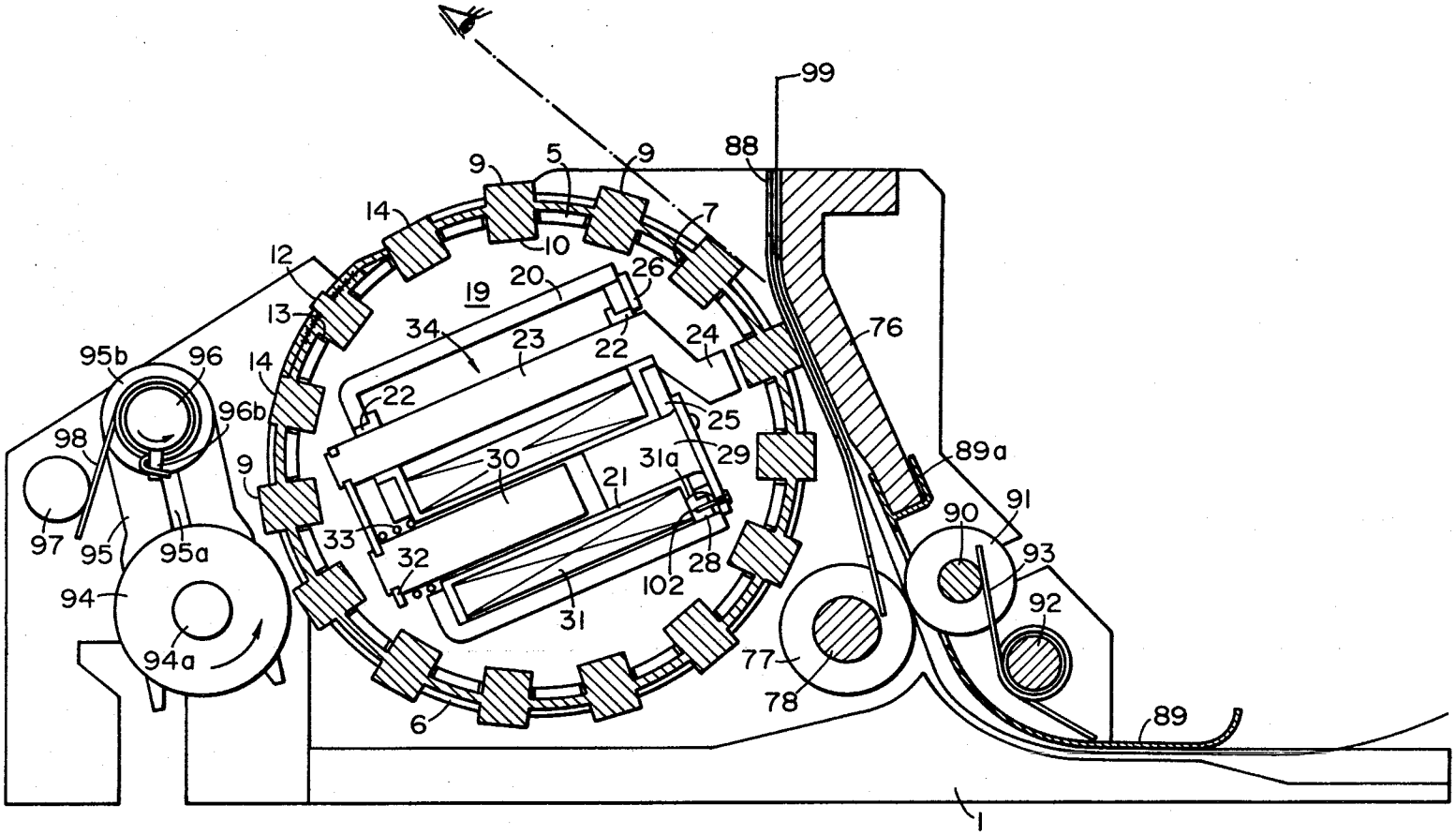
FIG. 4 is a lateral cross-sectional view of the embodiment.
Figure 5:
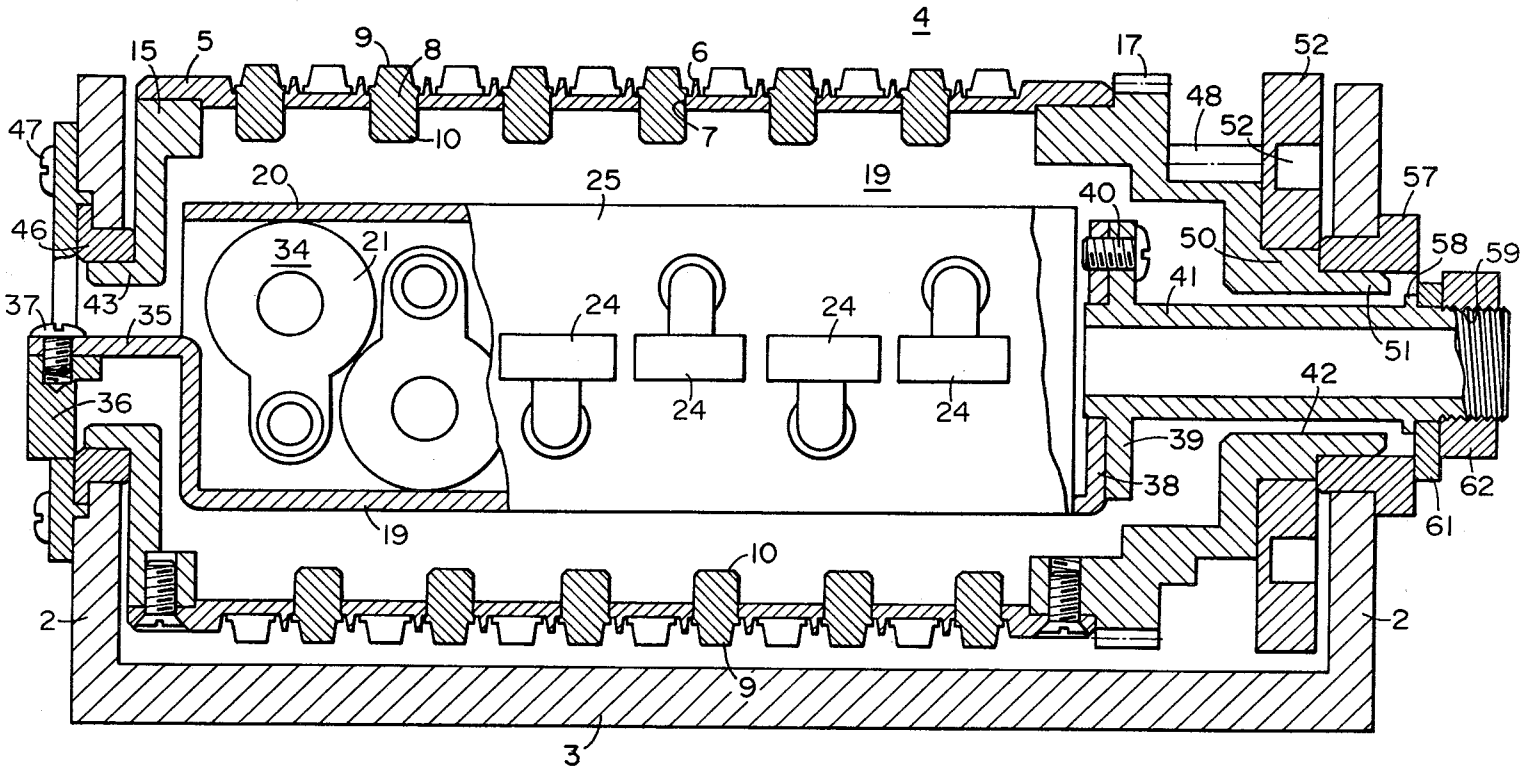
FIG. 5 is an axial cross-sectional view of the printing drum.

Inside the printing drum thus constructed there is accommodated a hammer assembly 19 having a yoke 20 of a square-U shaped cross section in which arranged in a line are a plurality of bobbins 21 having an egg-plant shape in plan view as shown in FIGS. 4 and 5. In a boss portion 22 provided above each of bobbins 21 there is slidably fitted a hammer 23 of which an end is bent as shown in FIG. 4 to form an impact plate 24 facing the internal periphery of the support member 5. As will be seen from FIG. 5, each impact plate 24 is so positioned as to cooperate with two adjacent typefont belts 8—8, but prints only one character in each operation because of the staggered arrangement of the protruding portions 10 of the adjacent typefont belt 8. Such structure of the hammer assembly in which each plunger cooperates with two typefont belts allows reduction in the space occupied by said assembly, thus enabling a high-density arrangement. In front of the bobbins 21 there is provided a front board 25 having a printed circuit board 26, while the bobbin 21 is provided on a protruding boss portion 28 with a pin 102' to which the wire 31' of a solenoid coil 31 is soldered, printed circuit board 26 and pin 102' being mutually soldered to achieve electrical connection.

A fixed core 29 is fixed on the front board 25 by caulking and fitted into the bobbin 21 by a determined length, and a movable core 30 is slidably fitted in bobbin 21 in facing position to fixed core 29. The coil 31 is so wound as to surround cores 29, 30. The outer end of movable core 30 and the outer end of hammer 23 are mutually connected by a bracket 32 which is elastically separated from the end face of the bobbin 21 by a coil spring 33. In order to achieve a rapid start at the printing operation the hammer 23 is made of a light material such as aluminum or a hard plastic material. The above-explained components around the bobbin constitute a plunger 34. The hammer 23 is normally separated from the typefont belt by means of the function of the coil spring 33 but, upon energizing of the coil 31, the movable core 30 is attracted therein to move the hammer 23 thereby performing a printing operation.

Figure 10:
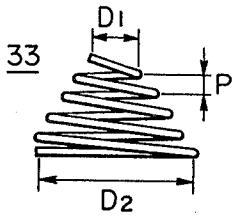
FIG. 10 is a lateral view of a conical coil spring.
Figure 11:
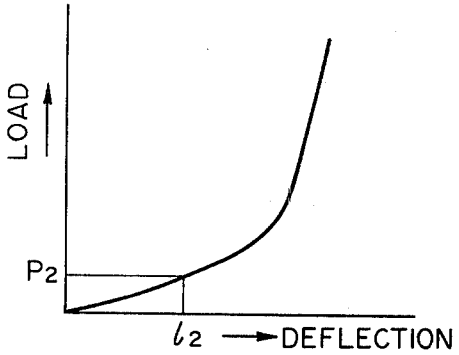
FIG. 11 is a plot showing the load-deformation characteristic of the conical coil spring.
Figure 12:
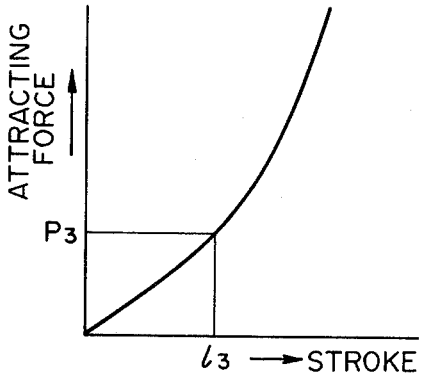
FIG. 12 is a plot showing the relation between the attractive force of the plunger and the stroke thereof.
Figure 13:
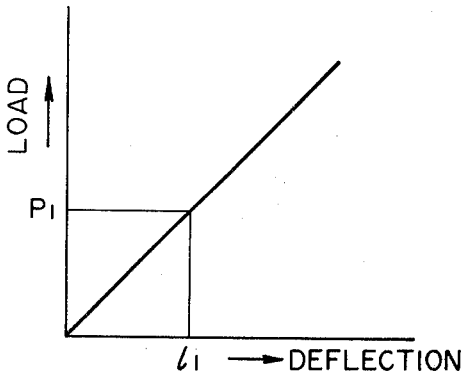
FIG. 13 is a plot showing the load-deformation characteristic of the cylindrical coil spring.

Coil spring 33 is preferably formed as a conical coil spring as shown in FIG. 10. Different from usual cylindrical coil springs, such conical coil spring is provided with a non-linear load-deformation characteristic as shown in FIG. 11 and is capable of providing advantageous properties, if the coil pitch P and coil diameters D1, D2 are suitably selected, for improving the start characteristic of the attraction-type plunger. More specifically, for a given solenoid showing an attractive force P3 at a stroke l2 of the movable core as shown in FIG. 12, a cylindrical coil spring applies a load or resistance P1 for a deformation l1 as shown in FIG. 13, thus absorbing the attractive force and thus retarding the start of motion. On the other hand a conical coil spring applies a load P2 much smaller than P1 for a deformation l1, thus reducing the resistance to the plunger and facilitating the start of motion with correspondingly reduced power consumption.

The hammer assembly 19 of the above-explained structure is accommodated in the support member 5 and is supported in the following manner. A support plate 35 integral with yoke 20 extends through a central opening 15 of bracket 15 and is fixed, by means of a screw 37, on a substantially L-shaped bracket 36 mounted on the outside of said board 2 of frame 1. Also a bent support plate 38 provided integrally at the other end of yoke 20 is fixed, by means of a screw 40, on a disk-shaped bracket 39 integral with a cylinder 41 extending to the outside through a central opening 42 in gear 17.

A boss portion 43 formed outside bracket 15 around the opening thereof is rotatably fitted in a bearing member 46 in turn fitted in a circular opening 45 which is provided in the side board 2 and is connected with a notch portion 44. Outside said bearing member 46 the aforementioned L-shaped bracket 36 is fixed to the side board 2 by means of a screw 47.

Said gear 17 is integrally provided, on the outer face thereof, with a partial gear 49 having teeth 48 over a determined angular range, and further provided with integral bosses 50, 51 with stepwise reduced diameters. A cam wheel 52 is fitted, by an opening 53 thereof, on boss 50 and is provided with a cam groove 54 which is concentric with opening 53 and is provided with mutually facing notches 54*a*, 54*b*. The gear 15 with cam wheel 52 is positioned is inside the other side board 2 of the frame, and boss 51 is rotatably supported in a boss 57 fitted in a circular opening 56 provided in the side board 2 and connected with a notch portion 55. The cylinder 41 extending beyond the boss 57 is provided at the outer end thereof with a flange 58 and a threaded portion 59, and flange 58 is fitted into an opening 61*a* of a bracket 61 fixed by screws 60 to the outside of the side board 2. Thus the cylinder 41 is secured in position by screwing a nut 62 on threaded portion 59.

On the outer face of the side board 2 facing cam wheel 52 there are provided bosses 63 for supporting, by means of screws 64, a support plate 65 on which a reed switch 66 is horizontally mounted.

On the other face of the side board 2 and in the vicinity of the aforementioned circular opening 56 there is provided a pin 67 for rotatably supporting a magnet lever 68 and a reversing lever 69 which are maintained in position by a C-ring 70.

Magnet lever 68 is provided at an end thereof with a pin 68*a* passing through a peripheral recess 57*a* on said boss 57 and having a D-sectioned portion engaging with the cam groove 54, and at the other end thereof with a permanent magnet 71 directed outwards.

The reversing lever 69 is provided at an end thereof with a pin 69*a* having a D-sectioned portion similarly engaging with the cam groove 54 and, is further provided with a torsion coil spring 72 in a boss portion 69*b* and engages at an end with magnet lever 68 to bias magnet lever 68 in the clockwise direction in FIG. 1. Also a spring 75 is provided between a pin 73 on the lower end of the reversing lever 69 and a pin 74 provided on the support plate 65 for biasing reversing lever 69 in the counter clockwise direction. The magnet lever 68 and the reversing lever 69 thus constructed perform lateral vibrating motion over a determined angular range by means of the rotation of cam wheel 52 and through the engagement with the cam groove 54, whereby permanent magnet 71 likewise performs a reciprocating motion to produce on and off signals from reed switch 66 in synchronization with the reciprocating motion.

Parallel to printing drum 4 and closer to a platen 76 constituting the front wall of the frame 1, a shaft 77 is rotatably supported by bearings 176—176 fitted on the side boards 2—2 and supports a rubber roller 78 for advancing the recording paper. On an end of shaft 77 loosely fitted are a gear 79 and a feed spring 80. The gear 79 has an outwardly extending boss 79*a* provided with a transversal groove 79*b* engaging with a protruding portion 81*a* of a boss 81 fixed to feed spring 80. Shaft 77 is provided, at the external end thereof, with non-circular cross sectioned portion 77*a* fitted with a corresponding aperture 82*a* of a ratchet wheel 82 to limit the rotation thereof, and a free end 80*a* of spring 80 engages with internal teeth 82*b* formed on the internal periphery of ratchet wheel 82. Gear 79 engages with the aforementioned gear 48.

On a shaft 83 protruding externally from the side board 2 in parallel to shaft 77, a manual knob 84 is rotatably supported and maintained thereon by a C-ring 85. A gear 84*a* formed integrally with said manual knob 84 engages with a gear 82*c* formed on the outer periphery of ratchet wheel 82.

A stepping motor 86 is mounted, by means of screws 86*a*, on bosses 76*b* provided on an external face of a bracket 76*a* protruding externally from the platen 76 of the frame 1, and an output gear 86*b* of the stepping motor is positioned inside the bracket 76*a* through an aperture 76*c* therein. A shaft 76*d* protrudes from the rear face of the bracket 76*a* and rotatably supports an intermediate gear 87 which engages with output gear 86*b* and with the aformentioned gear 17 to transmit the rotation of the stepping motor to the printing drum.

On the internal face of platen 76 there is positioned a comb-shaped paper guide 88, of which an end is fixed by inserting tongues 88*a* of semi-circular section formed at that end after elastic deformation into square holes 2*a* formed in the side board 2 of the frame 1, while the other end is fixed by inserting a protruding portion 88*b* into a small hole 76*e* formed on the platen 76 and inserting for example an unrepresented screw into a hole 88*c* provided on said protruding portion 88*b*.

An upper paper guide 89 is shaped in an arc form and is supported at the lower end thereof by L-shaped tongues 89*a* placed in position by the platen 76. Also the paper guide is fixed at an end in the longitudinal direction thereof to the bottom plate 3 by a screw fitted through a hole 89*b*, and also at the other end by inserting protruding member 89*c* with elastic deformation into a flat oblong hole 76*f* provided in the aforementioned bracket 76*a*.

In front of and below the platen 76 a shaft 90 is rotatably supported in the holes 2*b* formed in the side board 2 and rotatably supports a pinch rollers 91. A shaft 92 is provided parallel to shaft 90, and torsion coil springs 93 provided on shaft 92 engages at an end thereof with shaft 90 to bias the pinch roller 92 toward the aforementioned rubber roller 78.

In ink roller 94 is supported through a shaft 94*a* thereof by swinging levers 95 in a position opposite to rubber roller 78 across the printing drum 4. Swinging levers 95 are provided with central grooves 95*a* in which shaft 94*a* is elastically supported. Swinging levers 95*a* are provided at the upper ends thereof with cylindrical portions 95*b* which are fitted on end portions of shaft 96 rotatably mounted in holes 2*c* formed in the side boards 2—2. Also another shaft 97 is supported in similar holes 2*d* parallel to shaft 96 and in a position opposite thereto across the ink roller 94. On shaft 96 provided is a torsion coil spring 98 which engages at an end thereof with a pin 96*b* provided on shaft 96 while at the other end thereof with shaft 97 to bias the ink roller 94 toward the printing drum 4. 99 indicates a printing sheet.

Now there will be explained the function of the present embodiment explained in the foregoing.

Prior to the printing operation, pulse signals of the phases A, B, C and D are supplied with displaced timings to the stepping motor 86 in a manner to be explained later, thereby rotating the printing drum 4 in the clockwise direction by a determined angle for each pulse. Upon receipt of an instruction signal for printing a particular character from the control circuit in a manner to be explained later, the printing drum 4 is stopped at a position corresponding to that character, and a coil 31 of a selected plunger 34 is energized to attract the movable core 30 against the resistance of the coil spring 33, whereby the corresponding hammer 23 is advanced to hit, through the impact plate 24 thereof, a protruding portion 10 of a selected typing belt 8, thus pressing the recording sheet 99 against the platen 76 and achieving the printing of a character. In this moment the elastic typefont belt 8 is extended to ensure the clear printing.

During the printing operation, the recording sheet 99 is not advanced since the gear 79 is facing the non-toothed portion of the partial gear 49.

Upon completion of the printing operation and after a full turn of the gear 17, the partial gear 49 enters engagement with gear 79, and simultaneously the feed spring 80 engaging with gear 79 initiates rotation in the counterclockwise direction together with the boss 81. Also the ratchet wheel 82 is rotated to rotate the shaft 77, thereby driving the rubber roller 78 counterclockwise and advancing the recording sheet 99 supported in cooperation with the pinch roller 91 upwards by determined distance before the succeeding printing instruction signal.

Though in the foregoing embodiment the solenoid plungers are employed for driving the hammers, it is also possible to use mechanical drive utilizing cams or levers and to construct the drive mechanism as a serial printer instead of a parallel printer. The hammer 23 is naturally positioned perpendicularly to the platen 76, but is preferably directed upwards as shown in FIG. 4 while maintaining the above-mentioned relationship to the platen 76 because the printed characters, after paper advancement succeeding to the printing operation, becomes more easily and more rapidly observable. Such upward inclination of the hammers is preferably in a range from 10° to 30°, particularly at an angle of ca. 24°. In such a case the diameter of the printing drum is selected preferably in a range from 20 to 30 mm, particularly ca. 25 mm, with a type pitch (distance between the centers of two adjacent types) being ca. 4.4 mm.

In the following explained is the process control with reference to the attached timing chart and block diagram.

Figure 14:
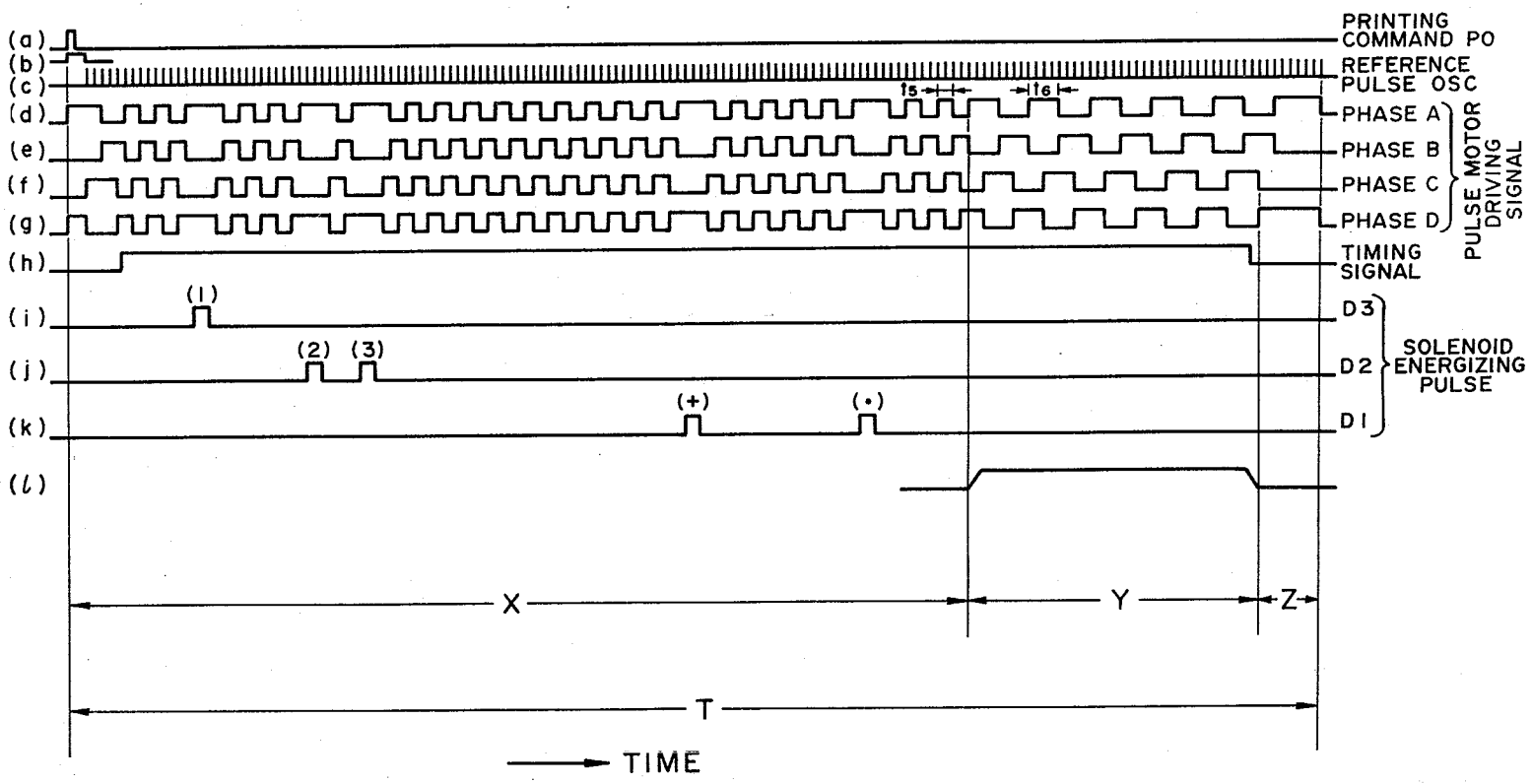
FIG. 14 is a timing chart showing the print cycle of the compact printer of the present embodiment.
Figure 16:
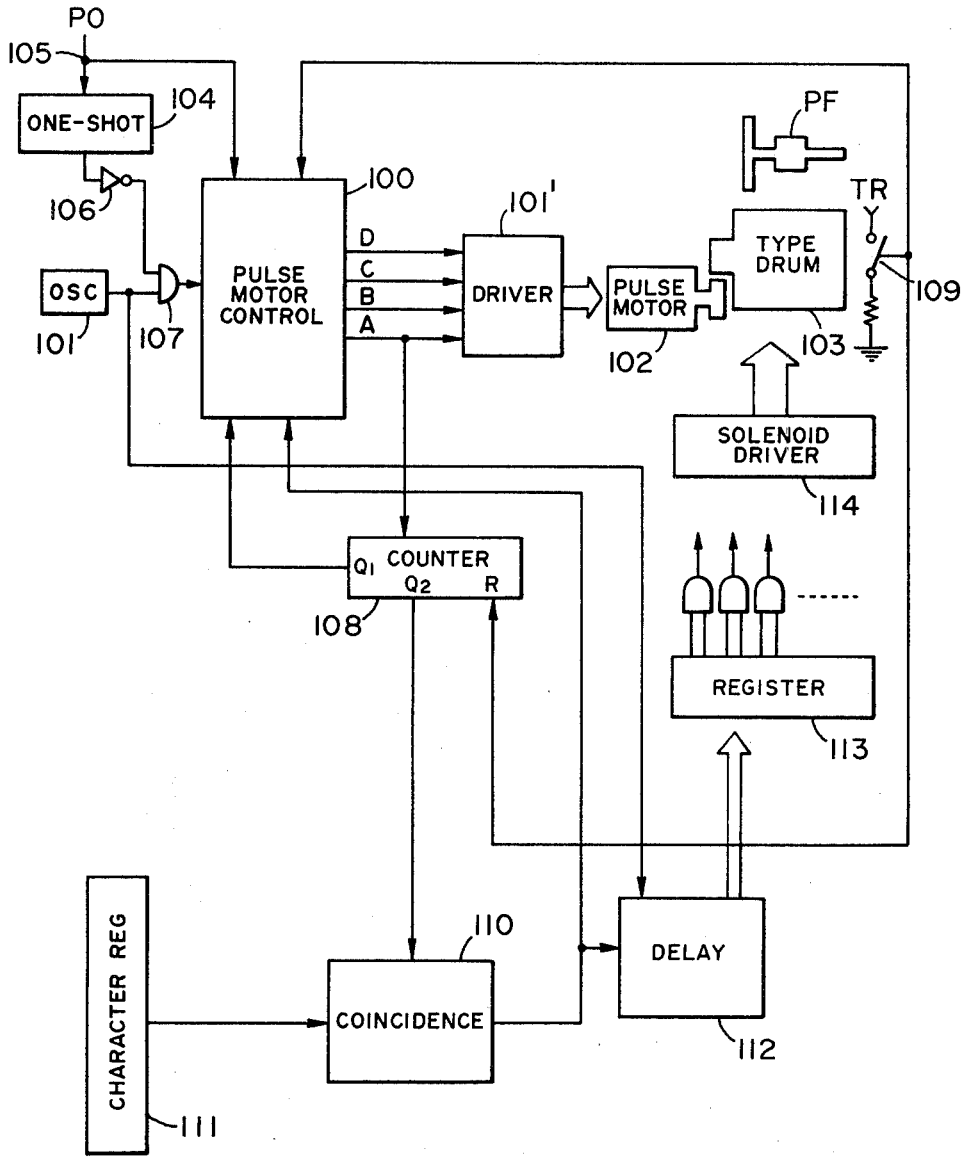
FIG. 16 is a schematic block diagram showing a control circuit.

FIG. 16 schematically shows a block diagram for controlling the printing operation in response to the printing instructions, wherein a stepping motor control 100 generates, in response to the signals received from a reference signal oscillator (OSC) 101, output drive pulses corresponding to the phases A to D of a phase relation suitable for driving a stepping motor 102 with a two-phase drive as shown in FIG. 14(*d*)-(*g*). Thus, the stepping motor 102 is driven by the two-phase driving process through a driver 101′ in response to the aforementioned pulses of different phases, thus rotating the printing drum 103.

The output pulses of the phases A to D from the control 100 are generated after determined periods from the entry of a printing instruction pulse PO (see FIG. 14(*a*)) to one-shot multivibrator 104 which is thereby activated to generate a pulse of a determined duration as shown in FIG. 14(*b*) to inhibit the entry of signals from the oscillator 101 through a gate circuit 107 during the pulse duration. Pulse PO is also directly supplied to the control 100 to enable the function thereof.

The phase-A outputs from the control 100 are supplied to and counted by a counter 108, which produces an output signal Q1 upon counting 24 phase-A output pulses to indicate the completion of the printing operation to the control 100. Pulse number 24 is derived, as will be explained later, from the number (12) of types present on a typefont belt and from the fact that stepping motions of at least a doubled number (24) are required for completing the scanning over each typefont belt because of the staggered arrangement of the adjacent typefont belts.

Counter 108 is reset, at the start of a printing cycle, at the positive-going edge of a timing signal TR (FIG. 14(*h*)) generated by the closing of the reed switch 109, and again counts the phase-A output signals supplied thereafter. Timing signal TR is terminated when the reed switch is opened at the end of a printing cycle after the paper feeding step. Counter 108 may also be designed to be reset at the negative-going edge of the timing signal TR. The timing signal is also supplied to the control 100 for controlling the printing cycle.

The content of counter 108 is compared, in a coincidence circuit 110, with the content of a character register 111 which stores the character information to be printed representing the result of processing in a computer. The data readout from the character register 111 is conducted in such a manner that the information of the odd-numbered digit positions are read at first, then the information of the even-numbered digit positions, again the information of the odd positions, and alternately thereafter, all in synchronization with the phase-A output pulses. For example, in case the content of the counter is "2", a series-input parallel-output register 113 stored, through a delay circuit 112, signals "1" in the digits corresponding to all the odd positions of the character register 111 having information "2", and signals "0" in all other digit positions. The output signals of register 113 corresponding to signals "1" drive, through a solenoid driver 114, associated solenoids (for example 6 solenoids are provided in the aforementioned manner for information of 12 digit positions) to print numerals "2". It is to be noted that all the typefont belts of odd positions on the printing drum are in a position corresponding to the numeral "2".

Then the information of the even positions are read from the character register 111, and similarly energized are the solenoids corresponding to digit positions containing information "2". In this state the printing drum is rotated by one step whereby all the typefont belts of the even digits are in a position corresponding to the numeral "2", thus enabling the printing of numeral "2" in the digits containing the information.

Then the output signal from the counter is shifted to "3", whereby the printing of numeral "3" is conducted at first in the odd digits containing information "3" and then in the even positions containing information "3". Thereafter the printing operation is continued in a similar manner for the numerals "4", "5", . . . in succession.

The output signal Q2 from the counter has to be incremented upon receipt of every two phase-A output pulses, but it is also possible to provide two counters respectively for the even and odd digit positions, receiving the phase-A output signals alternately. In FIG. 16, PF indicated a paper feed mechanism.

In FIG. 14, the signals (i) to (k) represent the timings for printing, for example, information "123.+". For the purpose of selecting a character in such type selecting-printing step X, the stepping motor has to be maintained stopped for a determined duration, as will be further explained in relation to FIG. 17.

Figure 17:
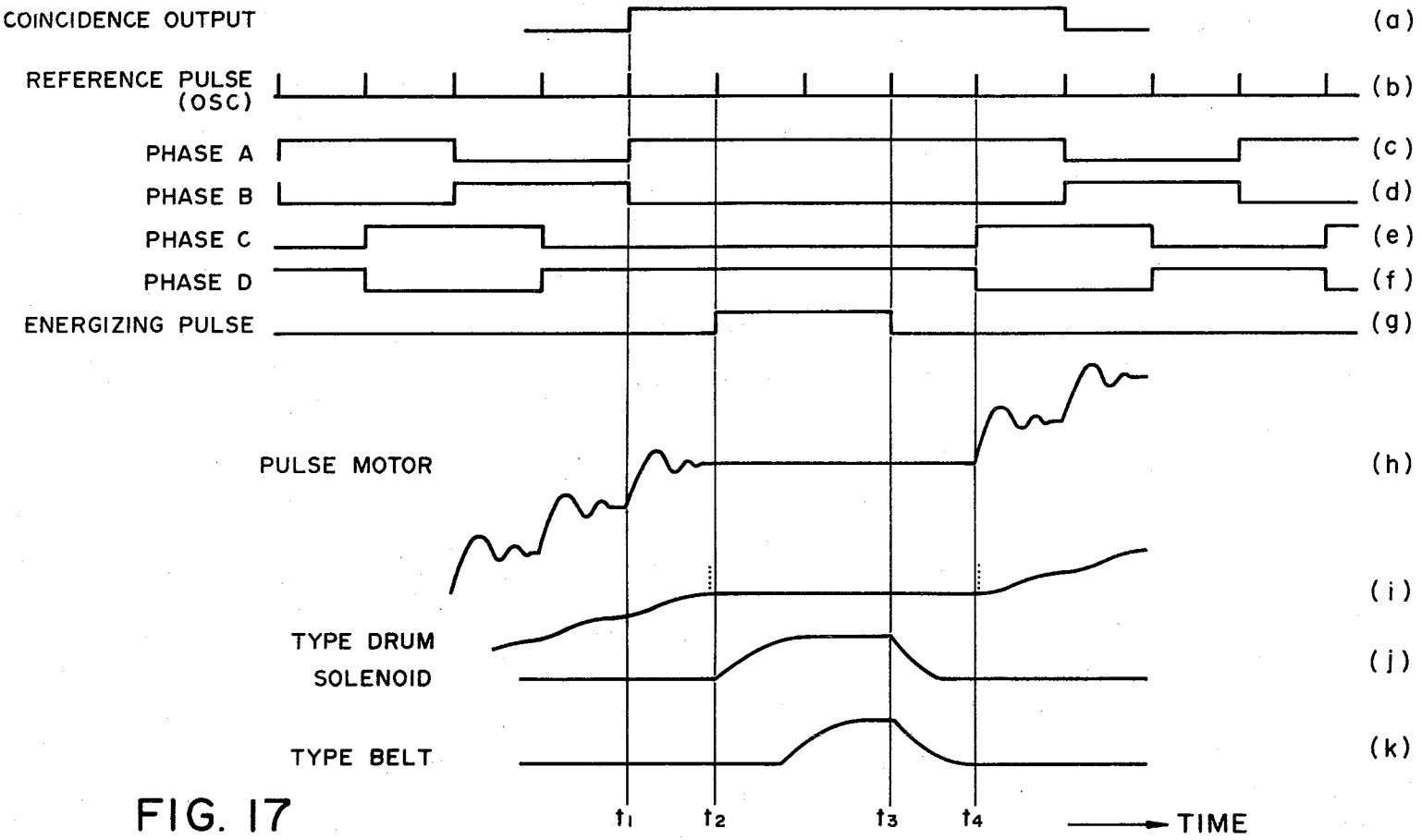
FIG. 17 is a chart detailedly showing the printing step in the print cycle.

FIG. 17 shows output pulses (a) from the coincidence circuit 110; reference pulses (b) from the oscillator 101; pulses (c)–(f) of phases A to D; an energizing pulse (g) supplied through the solenoid driver 114 to the selected solenoid; and amounts of movement (h)–(k) respectively of the stepping motor, printing drum, solenoid and typefont belt. When the coincidence circuit 110 develops an output pulse at a time t1, the solenoid is energized for a period from t2 to t3 corresponding to two reference pulses and delayed by the delay circuit 112 for a period corresponding to one reference pulse (FIG. 17(*g*)), while the stepping motor is maintained stopped until a time t4 corresponding to an immediately following reference pulse, so that the stepping motor is stopped for a period corresponding to four reference pulses. The printing drum 103 is brought to a standstill simultaneously with the stopping of the motor, and the solenoid is energized from t2 to t3 to perform printing operation by the hammer motion. The printing drum restarts the rotation after the lapse of a period required for the returning of the typefont belt (t3 to t4).

Figure 15:
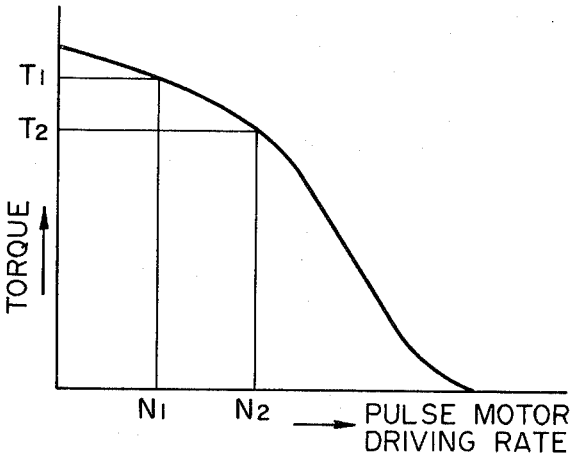
FIG. 15 is a plot showing the relation between the torque and driving rate of a stepping motor.

After type selecting-printing step X there is initiated a paper feeding step Y (FIG. 14(*l*)). In this state the counter 108 produces an output signal Q1 to the control 100 to extend the driving pulse duration from t5 to t6 thereby performing the paper feeding with an increased torque in step Y. Stated differently the stepping motor is driven with driving pulses of a shorter duration during the type selecting-printing step in which the motor load is lower, and is driven with driving pulses of a longer duration during the paper feeding step in which the motor load is higher (cf. FIG. 15). A compact inexpensive stepping motor can therefore be satisfactorily employed since the paper feeding is effected with an increased torque.

After the completion of paper feeding step Y there is effected a printing drum stabilizing step Z for a period corresponding to 6 referennce pulses, during which the duration of driving pulses is further extended. Various functions being securely accomplished in this manner, a printing cycle T is thus completed.

Figure 18:
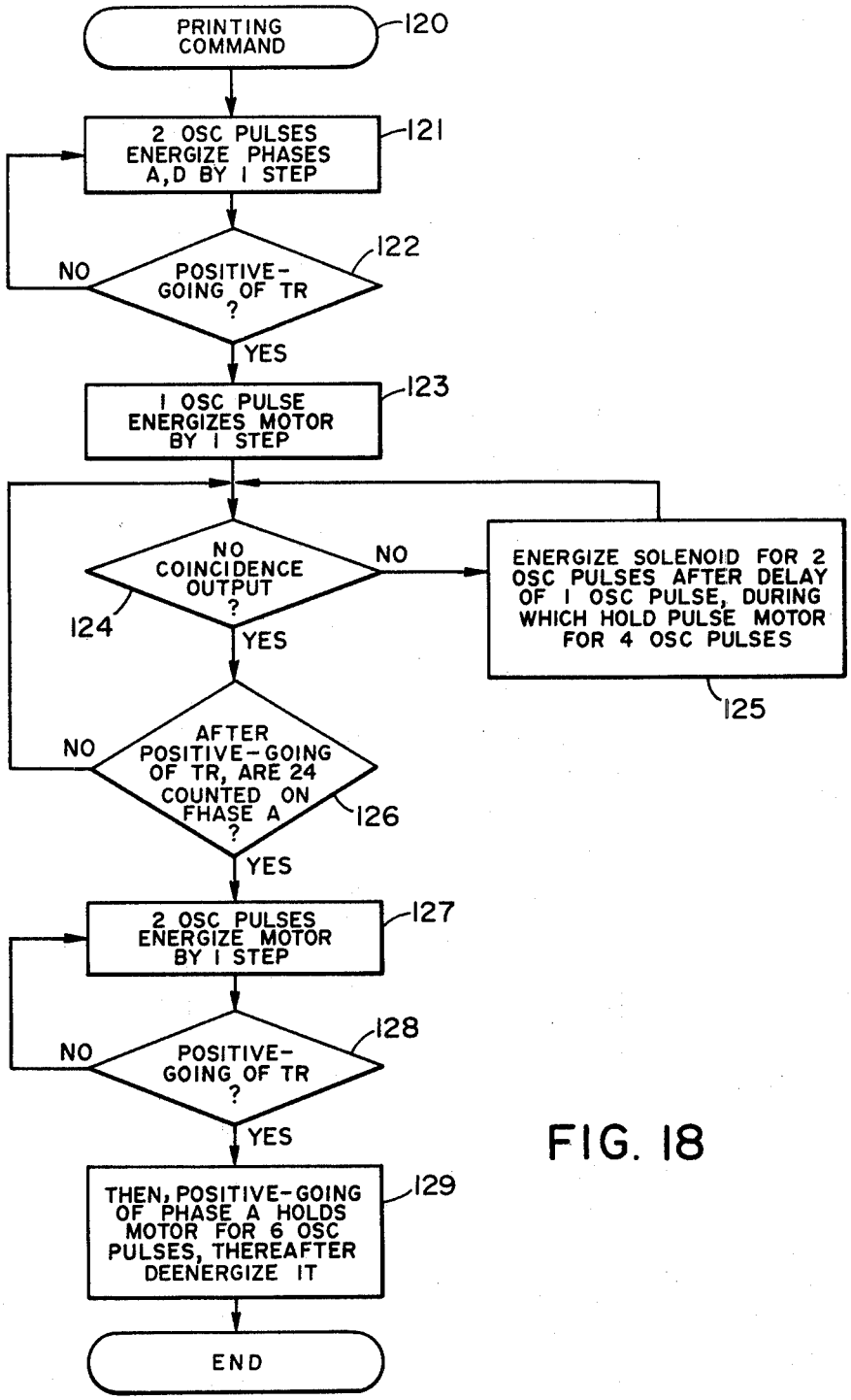
FIG. 18 is a flow chart showing the function control of the compact printer of the present embodiment.

The printing cycle shown in FIG. 14 will now be explained in relation to a flow chart shown in FIG. 18. Upon receipt of a printing instruction signal in the step 120, the motor drive is initiated from the phases A and D in the step 121, whereby the stepping motor is incremented in response to two reference pulses. Then the presence of a timing pulse TR is identified by the leading end thereof in the step 122, and, in the presence of the timing pulse the stepping motor is incremented in response to a reference pulse in the step 123. The step 124 judges whether or not to print according to the output from the coincidence circuit. In the case of the presence of a coincidence signal, the stepping motor is maintained stopped for a period corresponding to 4 reference pulses in the step 125 while the solenoid is energized for a period corresponding to two reference pulses after a delay corresponding to one reference pulse so that a printing is achieved.

In the absence of the coincidence signal, the step 126 identifies whether 24 phase-A pulses have been counted from the start of the timing signal, and, in case the counting is not yet completed, the program returns to the step 124 to identify the presence or absence of coincidence signal. When the type selecting-printing step is completed by counting 24 phase-A pulses, the program proceeds to the step 127 to initiate the paper feeding step, wherein the stepping motor is incremented in response to 2 reference pulses, to have a lower speed but an increase torque. Thereafter the step 128 identified the negative-going edge of the timing signal TR, and, upon the identification, the program proceeds to the following step 129 in which the stepping motor is maintained in stopped for a period corresponding to six reference pulses from the start of the succeeding phase-A pulse for stabilizing the printing drum, thus completing a printing cycle.

What we claim is:

1. A compact printer comprising:

a cylindrical support member;

a typefont belt having a plurality of printing types thereon and being wound around and fixed on said cylindrical support member, said typefont belt having a flat portion at each end of said typefont belt and having a protruding type-free portion on at least one of said flat portions, wherein said protruding type-free portion is lower in height than said printing types but higher in height than said flat portions;

an ink roller for engaging said typefont belt to supply ink to said plurality of printing types;

means for resiliently urging said ink roller towards said typefont belt; and means for transferring the ink supplied on to said plurality of types by said ink roller to a print paper.

2. A compact printer according to claim 1, wherein one end of said typefont belt is fixed to said cylindrical support member, and the other end is superposed on and adhered by an adhesive to the one end of said typefont belt.

3. A compact printer according to claim 1, wherein the flat portion of one end of said typefont belt is perforated to form a perforation, and said protruding type-free portion is formed on the flat portion of the other end of said typefont belt and fits into the perforation.

4. A compact printer according to claim 1, wherein said cylindrical support member has a plurality of holes perforated therearound, said typefont belt has a plurality of protrusions arranged on the side of said typefont belt opposite said plurality of types with each protrusion corresponding to a separate type, and said transferring means is accommodated within said cylindrical support member to project one of said plurality of types by pushing the one of said plurality of protrusions to transfer the ink supplied on said types to the print paper.

5. A compact printer according to claim 4, wherein said typefont belt includes a plurality of belt segments wound around said cylindrical support member, and the corresponding types on adjacent belt segments are arranged in a staggered manner.

* * * * *

UNITED STATES PATENT AND TRADEMARK OFFICE

CERTIFICATE OF CORRECTION

PATENT NO. : 4,458,589

DATED : July 10, 1984

INVENTOR(S) : Satoshi Watanabe, et al.

It is certified that error appears in the above-identified patent and that said Letters Patent is hereby corrected as shown below:

Column 1, line 43, change "eventually and nonsynchronization" to --nonsynchronization eventually--.

Column 3, line 12, change "chlorprene" to --chloroprene--.

Column 5, line 18, change "opening 15" to --opening 15'-- line 67, delete comma and after "54" insert a comma.

Column 6, line 67, change "rollers" to --roller--.

Column 7, line 2, change "92" to --91--.

Column 8, line 60, change "stored" to --stores--.

Column 10, line 20, delete "a";

line 31, change "identified" to --indentifies--;

line 35, delete "in".

Signed and Sealed this

Second Day of April 1985

[SEAL]

*Attest:*

DONALD J. QUIGG

*Attesting Officer*

*Acting Commissioner of Patents and Trademarks*